United States Patent [19]

Lyu

[11] Patent Number: 4,860,734

[45] Date of Patent: Aug. 29, 1989

[54] EXERCISING APPARATUS FOR ADJUSTING INTERVERTEBRAL DISC AND ARTICULATIONS CLEARANCES

[76] Inventor: Keun Chul Lyu, 129-172 Yongdu-Dong, Dongdaemun-Ku, Seoul 131, Rep. of Korea

[21] Appl. No.: 216,330

[22] Filed: Jul. 8, 1988

[30] Foreign Application Priority Data

Jul. 29, 1987 [KR] Rep. of Korea ..... 87-1241[U]
Dec. 12, 1987 [KR] Rep. of Korea ..... 87-2201[U]

[51] Int. Cl.[4] ..... A61H 15/00

[52] U.S. Cl. ..... 128/57; 128/25 R; 128/52; 272/144

[58] Field of Search ..... 272/144, 145; 128/24.3, 128/52, 25 R, 32, 70–74, 58, 51, 33; 269/325, 322, 323; 5/108, 109, 447; D24/3

[56] References Cited

U.S. PATENT DOCUMENTS

| | | | |
|---|---|---|---|
| 1,593,014 | 7/1926 | Bushmiller | 128/57 |
| 3,205,887 | 9/1965 | Henry | 128/57 |
| 3,450,132 | 6/1969 | Ragon et al. | 128/25 R |
| 4,052,100 | 10/1977 | Nikitits et al. | 297/159 |
| 4,101,164 | 7/1978 | Urdanoz | 297/159 |
| 4,111,482 | 9/1978 | Jones | 297/159 |
| 4,249,773 | 2/1981 | Giambalvo | 297/159 |
| 4,267,610 | 5/1981 | Blakeway et al. | 128/57 |
| 4,653,804 | 3/1987 | Yoo et al. | 297/159 |
| 4,752,980 | 6/1988 | Nafte | 5/108 |

*Primary Examiner*—S. R. Crow
*Attorney, Agent, or Firm*—Birch, Stewart, Kolasch & Birch

[57] ABSTRACT

A therapeutic exercising apparatus comprising a main frame having a plurality of rollers disposed therein, a cam connected to a movable rod, a pair of brackets for slidably moving under the rollers, and an adjustable member for controlling the height of one end of the main frame whereby the apparatus treats and massages and is used for adjusting intervertebral disc and articulations clearances.

12 Claims, 3 Drawing Sheets

EXERCISING APPARATUS FOR ADJUSTING INTERVERTEBRAL DISC AND ARTICULATIONS CLEARANCES

BACKGROUND OF THE INVENTION

1. Field of the Invention

The present invention relates to an exercising apparatus for adjusting intervertebral disc and articulations clearances which provides for relaxed adjustment of clearances of intervertebral and disc articulations by evenly massaging the lumbus the abdomen, intervertebral disc regions and the articulations such as the cervical vertebra, thoracic vertebra, and lumbar vertebra regions of the human body by rotation of ratatable rollers having a plurality of protrusions disposed on the outer surface thereof. The rollers are disposed in a main frame in an inclined position which may be adjusted so that a person lies on the main frame such as a couch or a therapeutic bed.

The exercising apparatus provides thereapeutic excercise for the following diseases: herniated inter vertebra disc (H.I.V.D.), neck and arm. pain, bruised muscles, post operative pain, post traumatic conditions of the spine, sprain and strain disorders causing pain and stiffness, hip and knee joint stiffness, muscular atrophy, lumbar lordosis, meuritis, frozen shoulder and tennis elbow, degenerated arthritis, parkinsonism, postural abnormalities, and the like.

2. Description of the Prior Art

There are many types of treating apparatuses or massaging apparatuses which are known in the art which retract by utilizing retractors for herniated intervertebral discs and which massage desired regions of the human body. However, such apparatuses require a user's assistant.

Recently, there are improved types of massaging apparatus which are well known in the art and which are structured with a plurality of rollers disposed on the inner surface of a main frame operated by use of the hands or feet of the user. However, the user cannot massage the whole body in a reclined state on the frame since the user must move his own body. Furthermore, such massaging apparatuses cannot adjust the intervertebral disc and articulations clearances.

Korean Utility Model publication No. 3078/1986 (published Nov. 8, 1986) discloses an apparatus for rubbing all of the human body which comprises a tetragonal frame for producing resilience by utilizing a spring which is secured to one end of a main frame of the apparatus. However, since a plate for producing resilience by utilizing the spring is elastically connected to the spring disposed on an inner part of the main frame, the user has to kick the plate continuously while lying on the rollers disposed on the inner part of the main frame. Furthermore, such apparatus is provided with the resilient force produced by kicking the plate through the use of the user's foot so that the user becomes tired immediately and may stop the operation of the apparatus. Therefore, optimum treatment and massage cannot be expected from such an apparatus. Also, the apparatus does not disclose the use of a means for adjusting the inclination angle depending on the personal weight of the user.

SUMMARY OF THE INVENTION

Accordingly, it is an object of the present invention to provide an exercising apparatus for adjusting intervertebral disc and articulations clearances, which includes a plurality rotatable rollers and reciprocating members for adjusting intervertebral disc and articulations clearances, massaging desired regions of the whole human body, and eradicating the above noted drawbacks.

Another object of the present invention is to provide an exercising apparatus for adjusting intervertebral disc and articulations clearances, which includes inclining members for smoothly adjusting a main frame which can be conveniently adjusted from a horizontal level to an inclined angle of 30 degrees.

A further object of the present invention is to provide a therapeutic apparatus which includes reciprocating members mounted to movable brackets which contain a plurality of rotatable rollers disposed on the inner surface of a main frame, an eccentric cam attached to one end of a motor, and an adjustable link eccentrically and pivotably connected to the eccentric cam for reciprocally moving the movable brackets so that the rotatable rollers are automatically rotated by operating the motor whereby the apparatus may treat and massage the lumbus, the abdomen, intervertebral disc regions and the articulations such as cervical vertebra, thoracic vertebra, and lumbar vertebra.

Still another object of the present invention is to provide an exercise apparatus which comprises an adjustable elevation which includes an adjustable screw rod rotated by an auxiliary motor through a pair of foldable members thereof for adjustably elevating or lowering the main frame within an angle of 30 degrees from a horizontal level of the main frame.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 5:
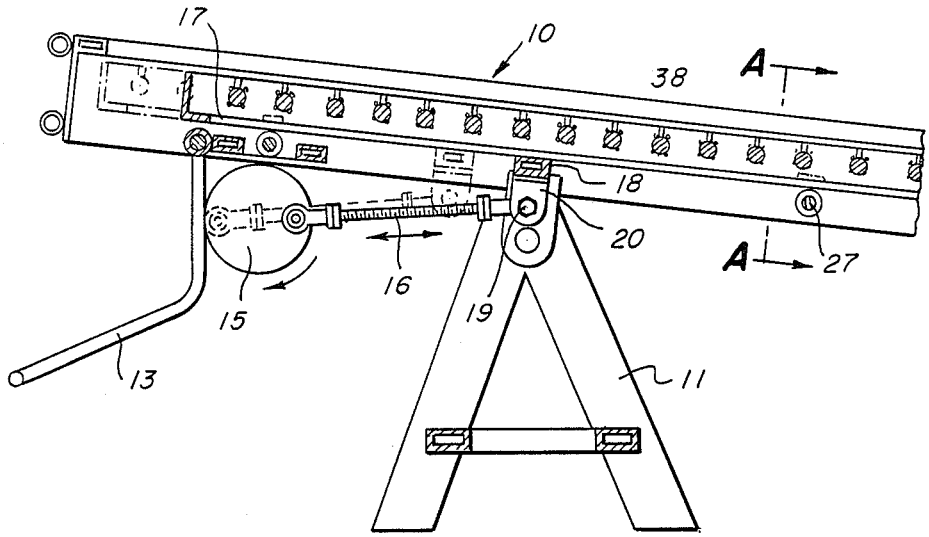
Figure 6:
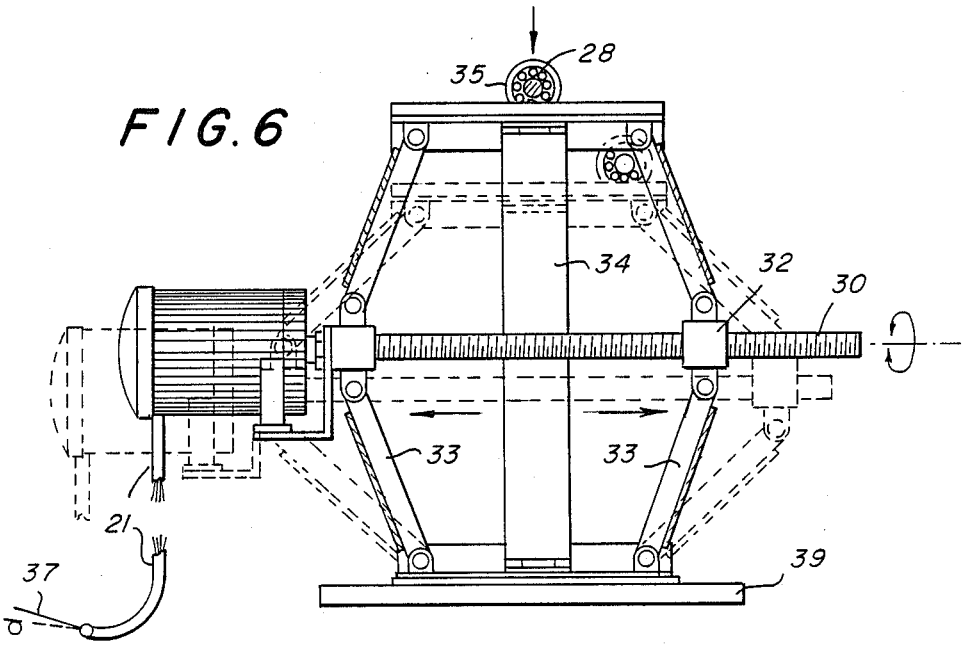
Figure 7:
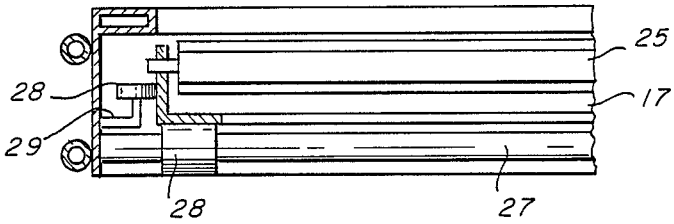

FIG. is an enlarged perspective view of an adjustable elevation member of the present invention;

FIG. 5 is a sectional view of showing the moving bracket of the present invention;

FIG. 6 is a front view of the elevation device of the present invention showing in cut away portions thereof adjustable plates; and FIG. 7 is a cross-sectional view of FIG. 5 taken along line A—A.

DETAILED DESCRIPTION OF THE INVENTION

Figure 1:
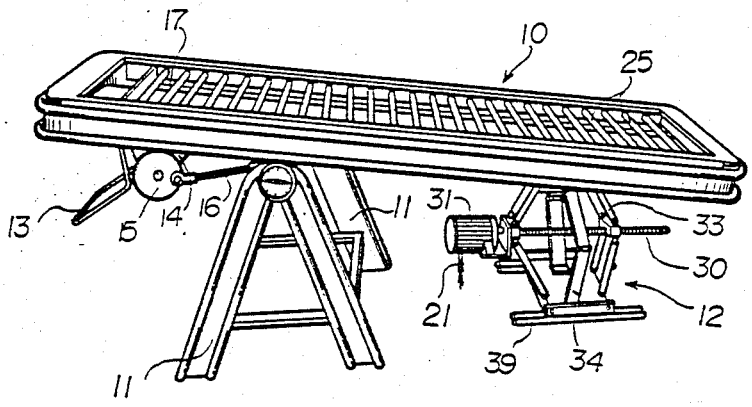
FIG. 1 is a perspective view of an exercising apparatus in accordance with the present invention.
Figure 2:
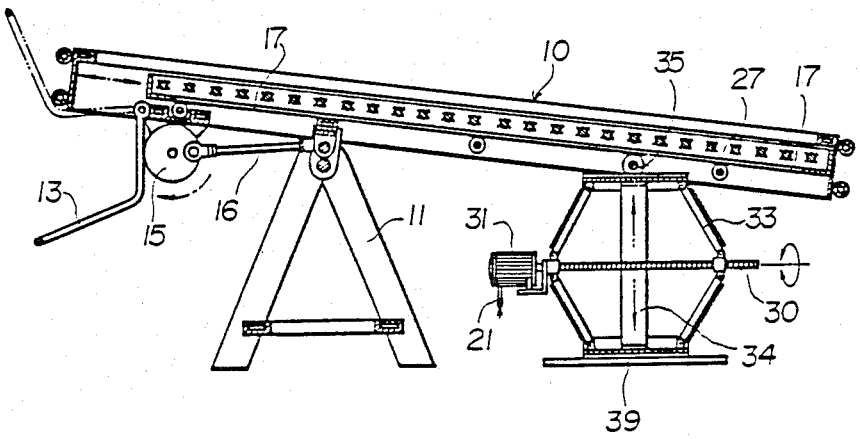
FIG. 2 is a sectional view of FIG. 1.

Referring now in detail to the drawings for the purpose of illustrating preferred embodiments of the present invention, the therapeutic exercise apparatus as shown in FIGS. 1 and 2 comprises a main frame 10 as a couch or a bed, a supporting member 11 supported to the main frame 10, an adjustable elevation member 12 supported to the bottom of one end of the main frame 10, and a fixing member 13 pivotably secured to the bottom of the other end of the main frame 10 for preventing the human body lying thereon from sliding from the main frame 10, and a main motor 14 mounted to the bottom of the other end of the main frame 10 and to a portion in the vicinity of the fixing member 13.

The main motor 14 is operatively connected to an electric wire 21 and is provided with an eccentric cam 15 attached to one end thereof. The eccentric cam 15 is connected to an adjustable link 16 at one end of the adjustable link 16 wherein the other end of the adjustable and movable link 16 is pivotably and eccentrically connected to a pair of movable brackets 17 through a supporting rod 18 by screwing a bolt 19 to a screwing member 20 attached to the supporting rod 18. The brackets 17 have a L-shaped configuration. The adjustable link 16 is provided with a screwing surface rod 22 and a pair of adjusting connectors 23 connected to both ends of the screw surface rod 22 for extending or shortening the adjustable and movable link 16 by screwing the adjusting connectors 23 (FIG. 3).

Figure 3:
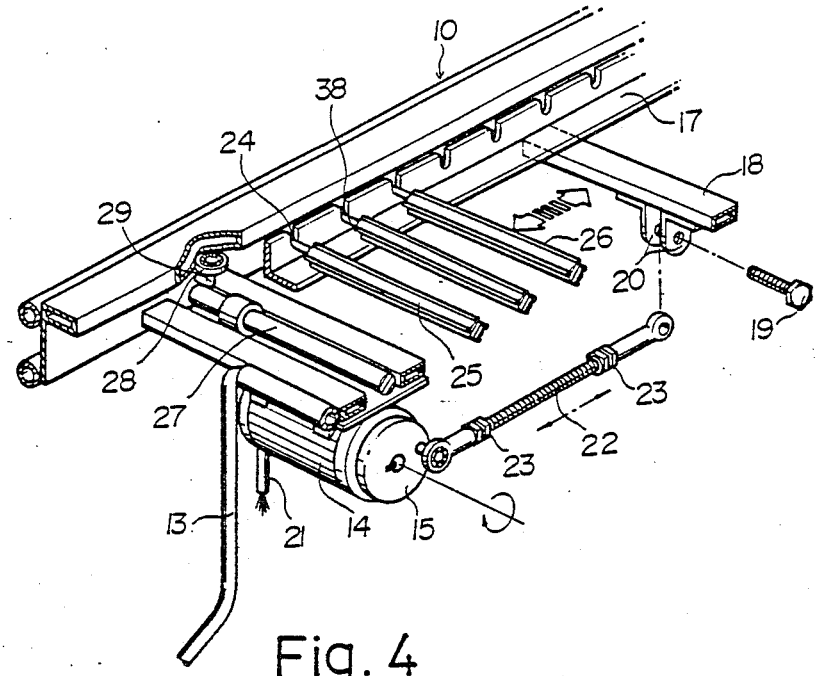
FIG. 3 is an enlarged perspective view of the exercising apparatus of the present invention showing in cut away portions thereof a moving bracket connected to an adjustable link.

As shown in FIG. 3, the L-shaped brackets 17 include a plurality of slots 24 for receiving a plurality of shafts 38 of rotatable rollers 25 in the plurality of slots, respectively. Each roller 25 has a plurality of protrusions 26 for massaging the human body reclined on the main frame 10. When the main motor 14 operates, the rollers 25 are substantially rotated by slidably moving the L-shaped brackets 17 through a reciprocal movement of the adjustable link 16.

As shown in FIGS. 5 and 7, the main frame 10 is provided with a pair of rods 27 having bearing members 28 for slidably contacting the brackets 17 at the bottom surface of the L-shaped brackets 17 and a pair of stands 29 having the bearing members 28 for slidably contacting the brackets 17 at the side wall of the L-shaped brackets 17.

Figure 4:
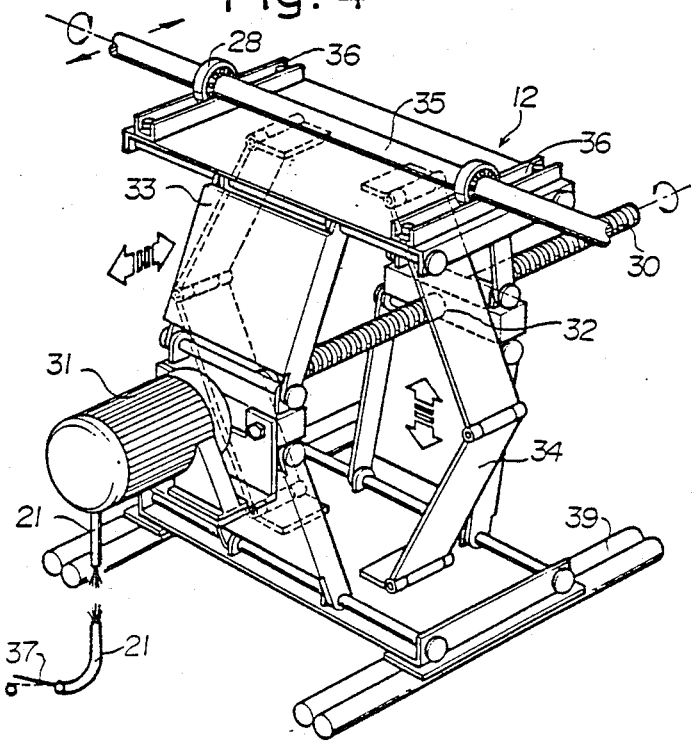

As shown in FIGS. 4 and 6, the adjustable elevation member 12 includes an adjusting screw member 30 connected to an auxiliary motor 31, which is turned by the rotation of the auxiliary motor 31 and is rotatably mounted in apertures 32 operatively connected to a pair of foldable supporters 33. The apertures 32 are disposed in the middle portions of the foldable supporters 33 which adjust the height of the adjustable elevation member 12. That is, the height of one end of the main frame 10 is controlled by the height of the adjusting elevation member 12. The adjusting elevation member !2 further includes a pair of foldable auxiliary supporters 34 disposed between the main foldable supporters 33, respectively, and a rotatable rod 35 having a pair of bearing members 28 adapted to engage in a pair of rails 36 disposed on the top portion of the adjustable elevation member 12 for slidably moving upon the elevation or lowering of the elevation member 12.

The auxiliary motor 31 is operated by the operation of a direction-selected switch 37. Thus, since the auxiliary motor 31 is a reversible motor, the adjusting screw member 30 is moved forward and backward by the operation the direction-selected switch 37 through the rotation of the auxiliary motor 31 in a clockwise direction or counterclockwise direction so that the adjustable elevation member 12 can be elevated or lowered within an angle of 30° from the horizontal level of the main frame 10 depending on the personal weight of the user.

In operation, the user reclines on the main frame 10 as with a couch or a bed and the fixing member 13 is lifted for preventing the human body of the user from sliding from the main frame 10 (FIG. 2). At this time, the adjustable elevation member 12 is adjusted by the operation of the direction-selected switch 37 to a desired inclining angle of one end of the main frame 10 which depends on the personal weight of the human body of the user (FIGS. 4 and 6). Thereafter, when the main motor 14 is operated by the user through an on/off switch (not shown), the eccentric cam 15 is operated and simultaneously the adjustable, movable link 16 moves back and forth so that the pair of brackets 17 also moves back and forth (FIG. 3). Therefore, the rollers 25 rotate under the human body directly contacting and manipulating various portions of tissue of the human body reclining thereon. Thus, the therapeutic exercise apparatus is utilized for the human body particularly, a intervertebral disc and articulations patient in need of massaging of desired regions of the human body lying thereon.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A therapeutic exercising apparatus for adjusting intervertebral disc and articulations clearances comprising:

a main frame supported by a supporting member, an eccentric cam attached to a motor mounted below a first end of said main frame, a movable and adjustable link connected to said eccentric cam at a first end thereof, a pair of movable brackets disposed in said main frame, said pair of movable brackets being connected to a second other end of said movable link, a plurality of rotatable rollers disposed between said brackets and forming a bedfloor, and elevation member supported below a second end of said main frame, said adjustable elevation member including a plurality of foldable supporters and an adjusting screw member operatively connected to said plurality of supporters and to a direction-changeable motor for controlling the height of said adjustable elevation member whereby, the plurality of rollers contact and rotate under a human body lying on the bedfloor of the main frame upon being moved back and forth by the brackets through the movement of the movable link so that the rotating rolling rollers treat and massage regions of the human body lying thereon.

2. The therapeutic exercising apparatus of claim 1, wherein the main frame is provided with a fixing member pivotably mounted to one end thereof for preventing the user lying thereon from aiding from the main frame.

3. The therapeutic exercising apparatus of claim wherein the movable and adjustable link includes a screwing surface rod and a pair of adjusting connectors for controlling the length of said link by adjusting the pair of connectors.

4. The therapeutic exercising apparatus of claim 1, wherein the brackets are secured to a supporting rod for connecting the movable and adjustable link at the other end of the link.

5. The therapeutic exercising apparatus of claim 1, wherein the brackets have an L-shaped configuration.

6. The therapeutic exercising apparatus of claim 5, wherein the brackets are provided with a pair of rods having bearing members for slidably contacting the bottom of the L-shaped brackets.

7. The therapeutic exercising apparatus of claim 5, wherein the brackets are provided with a pair of stands having bearing members for slidably contacting the side wall of the L-shaped brackets.

8. The therapeutic exercising apparatus of claim 1, wherein the rollers having shafts which are engaged in a plurality of slots disposed in the brackets through said shafts, respectively.

9. The therapeutic exercising apparatus of claim 8, wherein the rollers are provided with a plurality of protrusions disposed thereon for massaging regions of the human body.

10. The therapeutic exercising apparatus of claim I, wherein a pair of the foldable supporters of said adjustable elevation member include an aperture, respectively, so that the adjusting screw member rotates and passes through said apertures.

11. The therapeutic exercising apparatus of claim 10, wherein the adjusting screw member is mounted to the direction-selected motor at one end thereof, said direction-selected motor having a direction-selected switch.

12. The therapeutic exercising apparatus of claim 1, wherein the adjustable elevation member further includes a pair of rails disposed thereon for receiving a pair of bearing members mounted to a rotatable rod which is slidably mounted on the bottom of the main frame.

* * * * *